US009561400B2

(12) United States Patent
Soerensen

(10) Patent No.: US 9,561,400 B2
(45) Date of Patent: Feb. 7, 2017

(54) SENSOR UNIT FOR QUANTIFICATION OF PHYSICAL TRAINING WITH RUBBER BAND

(71) Applicant: BANDCIZER ApS, Odense V (DK)

(72) Inventor: Anders Stengaard Soerensen, Odense V (DK)

(73) Assignee: BANDCIZER ApS, Odense V (DK)

( * ) Notice: Subject to any disclaimer, the term of this patent is extended or adjusted under 35 U.S.C. 154(b) by 15 days.

(21) Appl. No.: 14/399,816

(22) PCT Filed: May 1, 2013

(86) PCT No.: PCT/DK2013/050123

§ 371 (c)(1),
(2) Date: Nov. 7, 2014

(87) PCT Pub. No.: WO2013/167129

PCT Pub. Date: Nov. 14, 2013

(65) Prior Publication Data

US 2015/0157896 A1 Jun. 11, 2015

(30) Foreign Application Priority Data

May 7, 2012 (DK) ..... 2012 00312

(51) Int. Cl.
*A63B 24/00* (2006.01)
*A63B 71/06* (2006.01)
(Continued)

(52) U.S. Cl.
CPC ..... *A63B 24/0062* (2013.01); *A63B 21/0004* (2013.01); *A63B 21/0552* (2013.01);
(Continued)

(58) Field of Classification Search
CPC ..... A63B 21/0055; A63B 21/00043; A63B 21/0004; A63B 21/055; A63B 21/0552; A63B 24/00; A63B 24/0062; A63B 71/0622; A63B 2209/08; A63B 2220/51; A63B 2220/805; A63B 2220/833; A63B 2220/89; A63B 2225/20; A63B 2225/50
See application file for complete search history.

(56) References Cited

U.S. PATENT DOCUMENTS 3,498,609 A * 3/1970 Lukens ..... A63B 21/055 482/125
4,824,103 A * 4/1989 Smidt ..... A61B 5/1107 482/9
(Continued)

FOREIGN PATENT DOCUMENTS

CN 201109634 Y 9/2008
CN 201220056 Y 4/2009
(Continued)

*Primary Examiner* — Glenn Richman
(74) *Attorney, Agent, or Firm* — Merchant & Gould P.C.

(57) ABSTRACT

A sensor unit (18) adapted for mounting on a rubber band (17) for physical training. The sensor unit comprises attachment means such as a clamp (4, 5), means (10) for measuring the tension of the rubber band, a power source (1), a processor (11) and optionally a signal transmitter (12) for cable or wireless data transfer. In one embodiment, the means for measuring the tension is an integral part of the attachment means. In another embodiment, the means for measuring the tension is adapted to measure the mechanical resonance frequency of the rubber band.

16 Claims, 2 Drawing Sheets

(51) Int. Cl.
*A63B 21/00* (2006.01)
*A63B 21/055* (2006.01)

(52) U.S. Cl.
CPC ..... *A63B 71/0622* (2013.01); *A63B 2209/08* (2013.01); *A63B 2220/51* (2013.01); *A63B 2220/805* (2013.01); *A63B 2220/833* (2013.01); *A63B 2220/89* (2013.01); *A63B 2225/20* (2013.01); *A63B 2225/50* (2013.01)

(56) References Cited

U.S. PATENT DOCUMENTS

| | | | | |
|---|---|---|---|---|
| 4,912,638 | A * | 3/1990 | Pratt, Jr. | A61B 5/1121 128/905 |
| 5,538,486 | A * | 7/1996 | France | A63B 21/0004 177/245 |
| 5,656,004 | A | 8/1997 | Useldinger et al. | |
| 6,662,651 | B1 | 12/2003 | Roth | |
| 7,652,953 | B1 * | 1/2010 | Fluegge | A63B 21/00043 368/10 |
| 7,743,656 | B1 | 6/2010 | Dickinson et al. | |
| 8,491,446 | B2 * | 7/2013 | Hinds | A63B 21/0055 482/126 |
| 2007/0105696 | A1 | 5/2007 | Castel et al. | |
| 2008/0119763 | A1 | 5/2008 | Wiener | |

FOREIGN PATENT DOCUMENTS

| | | | |
|---|---|---|---|
| CN | 201235172 | Y | 5/2009 |
| CN | 202020667 | U | 11/2011 |
| DE | 202006019720 | U1 | 4/2007 |
| FR | 2899090 | A1 | 10/2007 |
| GB | 2210694 | A | 6/1989 |
| JP | 2002-131156 | A | 5/2002 |
| JP | 2006-340944 | A | 12/2006 |
| TW | 200930998 | A | 7/2009 |
| WO | WO 00/12041 | A2 | 3/2000 |
| WO | WO 2007/053884 | A1 | 5/2007 |
| WO | WO 2007/104302 | A1 | 9/2007 |
| WO | WO 2011/041678 | A1 | 4/2011 |
| WO | WO 2012/085502 | A1 | 6/2012 |
| WO | WO 2013/138302 | A1 | 9/2013 |

* cited by examiner

SENSOR UNIT FOR QUANTIFICATION OF PHYSICAL TRAINING WITH RUBBER BAND

This application is a National Stage Application of PCT/DK2013/050123, filed 1 May 2013, which claims benefit of Serial No. PA 2012 00312, filed 7 May 2012 in Denmark and which applications are incorporated herein by reference. To the extent appropriate, a claim of priority is made to each of the above disclosed applications.

FIELD OF THE INVENTION

The present invention relate to a sensor unit that can be placed on an exercise rubber band and measure the strain of the rubber band. The sensor unit can be used to monitor and record performed work as well as training intensity during a rubber band training session. The sensor unit can be used self-contained, or transfer data to a communication network, a server, a personal computer, mobile phone, tablet PC, or similar terminals, where the measurements can be visualized, stored, transmitted or analyzed.

BACKGROUND OF THE INVENTION

Rubber bands are used in many training regimes for physical training, and are often used for home or workplace training, for fitness, preventive, rehabilitative training, and physical therapy. However, no objective method exists for measuring the extent or intensity of the performed training, other than simply counting the number of repetitions carried out by the user. It is estimated that more than 50% of physical-therapy patients have a non-satisfactory compliance with assigned home training.

In practice, physical therapists attempt to control the "training dosage", by:

1. Choosing between different types of rubber-bands with different force-to-length ratios (elasticity);
2. Adjust the length of the rubber-band;
3. Instruct the patient/user in specific exercises;
4. Instruct the patient/user in the amount of repetitions, speed and breaks during the exercise;
5. Follow up on executed training, by observing or interviewing the patient/user.

Products exist that combine rubber bands with monitoring of hand or limb motion, using accelerometers, gyroscopes or cameras, such as the Nintendo Wii or X-box Kinect. These solutions provide an inaccurate estimation of force or strain, and are not used in practice, for measuring serious or clinical training.

Hence, there is still a need for a simple device that can monitor the exercise performed with a rubber band.

SUMMARY OF THE INVENTION

By using a sensor unit of the present invention the above discussed problems can be solved. The sensor unit is simply attached to the rubber band, and the rubber band sensor assembly, will appear as an integrated training device. The measurements are done directly on the rubber band, with better precision than existing products. The sensor unit can provide direct feedback during training, using an integrated signaling device or display. The sensor unit can pass on measurements to external units or communication networks, that can provide feedback to the user during training, visualize the performance, evaluate performance, store data, or pass data on.

Specifically the present invention provides a sensor unit for monitoring physical training with a rubber band. In one embodiment the sensor unit comprises a housing enclosing:

- a frame;
- attachment means, such as fixing clamps, for attaching the sensor to the rubber band;
- power source;
- means for measuring the tension of the rubber band, said means being associated with the attachment means;
- an internal or remote processor for processing data received from the means for measuring the tension of the rubber band
- signal transmitter for cable or wireless data transfer of the data to an external device;

wherein the means for measuring the tension is an integral part of the attachment means.

Preferably the sensor unit is fixed onto the rubber band by squeezing the rubber with a force generated by a spring or resilient element that may be a separate component or an integral part of the attachment means. In an alternative embodiment the assembly is held on the rubber band by squeezing the rubber band with a force created by magnetism. In another alternative embodiment the device is held on the rubber band by winding or binding the rubber band around the sensor assembly or components of the sensor assembly. In yet another alternative embodiment the assembly is held on the rubber band, by passing the rubber band through one or more holes, slots, rings or hooks in the attachment means. The tensile force or the variation of the tensile force may be measured by means of one or more detectors that are sensitive to, or coupled to, the mechanical deformation in one or more dimensions of the rubber band.

In one preferred embodiment the deformation or variations of the rubber band is measured by means of an electronic circuit comprising two or more electrical conductors in a structure completely or partially based on measuring their mutual capacity as a function of the deformation of the rubber band.

In another preferred embodiment the deformation of the rubber band or variations therein is measured by means of magnetic coupling between two or more elements in a magnetic circuit, in a construction where the magnetic coupling is a function of the mechanical deformation of the rubber band.

In yet another preferred embodiment the deformation of the rubber band or variations therein is measured by means of the transmission of electromagnetic radiation in a structure where the transmission of the radiation from one or more sources is a function of the mechanical deformation of the rubber band.

Alternatively the tensile force of the rubber band is transferred to the sensor assembly by the attachment means, as tension or compression, and is measured directly by one or more pressure or force sensitive measuring devices.

DETAILED DESCRIPTION OF THE INVENTION

Figure 1:
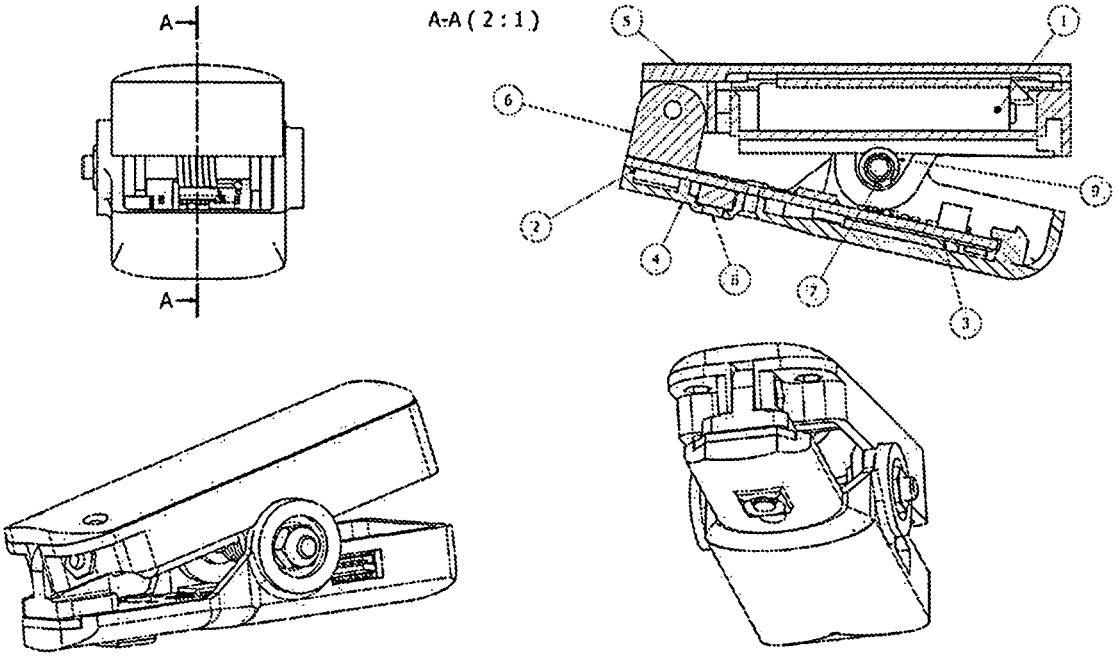
FIG. 1 shows an embodiment of the unit, with wireless data-transfer, using a Bluetooth connection to a mobile phone or PC that act as user interface for the sensor.
Figure 2:
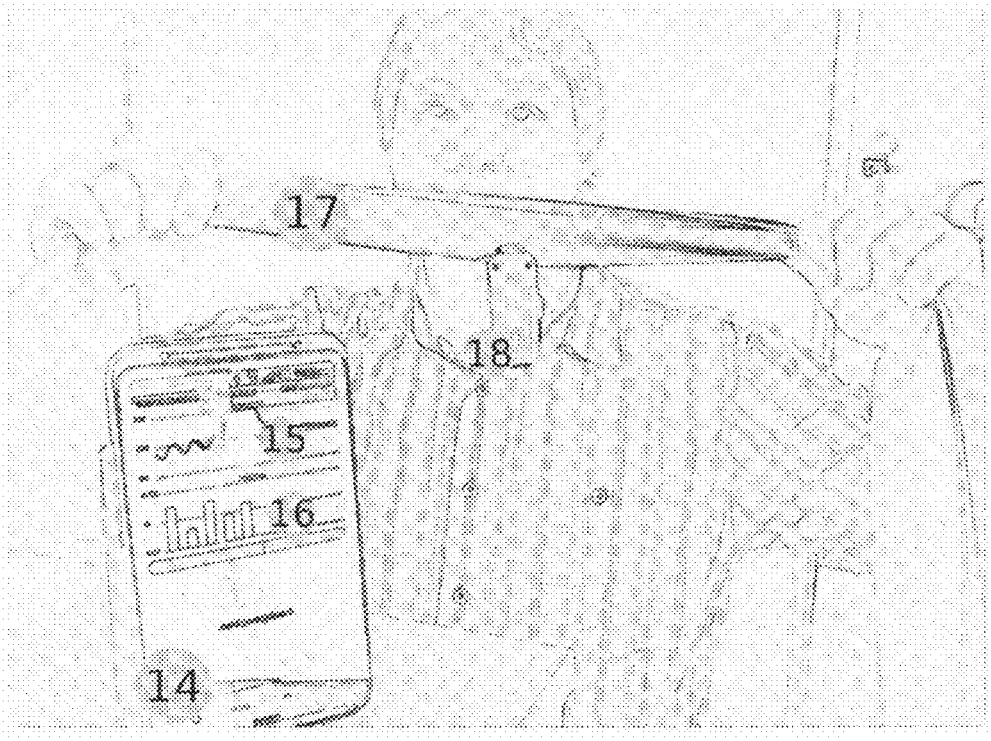
FIG. 2 shows how the unit can be applied in a training session.

The present invention is an aggregation of a chassis (or housing), a mounting mechanism, a sensor for measuring mechanical strain or deformation, and one or more of the following elements: Embedded computer; Energy supply; Display; Speaker; wired- or wireless data connection.

Mounting mechanism, sensor, and chassis can be fully or partially integrated, depending on the specific embodiment. The sensor unit is constructed to be mounted on a rubber band in a way that enables measurement of strain or deformation, for instance by pinching the rubber band. As deformation and strain are related, different sensor principles can be applied to measure the strain directly or indirectly.

The relative force, compared to training instruction or previous training can be determined directly. The absolute force can be calculated by calibration against a known force. Such calculations can be performed by a computer embedded in the sensor unit, or an external unit.

An embodiment with integrated display or sound device, can give direct readings of instantaneous or historical data. Embodiments with other signaling devices, for instance lamps or a vibrator, can give less detailed feedback, as, for instance compliance with pre-programmed goals or training rhythm.

Embodiments with wired or wireless data-communication make it possible to associate external devices or networks, with possibilities for transfer of collected data, or instantaneous streaming of data during training. Such embodiments makes it possible to visualize, print, store, analyze and transmit training data, using existing information technology, such as personal computers, phones, tablets, and routers. Hence, it becomes possible to integrate training with video games, electronic social networks, electronic journals, and communication with therapist or personal trainer through existing electronic media.

Referring to the figures the sensor (18) is constructed around a two-part mechanical chassis, comprising an upper part (5) and a lower part (4). The two parts are assembled with a bolt (7) and a spring (9), so that they form a mechanical clamp, able to grip the rubber-band (17). The upper part encapsulates two AAA batteries (1) and the lower part encapsulates a printed circuit board (PCB) (2). The front end of the PCB, comprise an electrode-pair (10) which mutual capacity is measured and digitized by an analog to digital converter (13) and read my a microcontroller (11), that can communicate with external units using a Bluetooth transceiver (12). The sensor grip the rubber-band with a jaw (6) with an electrically conductive surface. The jaw (6) is mounted on the upper part (5), in such a way, that the rubber-band (17) is clamped between the electrode pair (10) and the jaw. Electrode pair (10), rubber-band (17) and jaw (6) form a capacitor, which capacitance varies with the thickness of the rubber-band (17). The unit is equipped with a pushbutton (8) and a light emitting diode (12), both connected to the micro controller. They can be used for on/off functionality or other simple user interaction.

The microcontroller (11) is programmed to read the capacity, and transfer the measurement to an external unit via the Bluetooth transceiver (12). The functionality of the sensor unit is demonstrated through a user interface, implemented as an application on a commercially available mobile phone (14). The user interface contains a graph (15) that continuously shows the strain of the rubber-band as a function of time. The user interface also contains a bar-graph that shows the maximum strain in a series of exertions. The phone forward data through the internet, to a database, where training data is stored, and can be shared with trainer or therapist.

ALTERNATIVE EMBODIMENTS

In an alternative embodiment, the spring force to clamp the rubber-band, is achieved by designing the chassis, or parts of the chassis as a spring or elastic (resilient) element. In such an embodiment, the chassis can be manufactured without separate top and bottom parts.

In an alternative embodiment, the sensor is attached to the rubber-band, using one or more magnets, so the force for mounting or deformation measurement is achieved by magnetic attraction between one or more magnets and a ferromagnetic element, or between two or more magnets. In such an embodiment, the sensor unit can be manufactured as two separate parts.

In an alternative embodiment, the rubber-band is wound or tied around the sensor unit, or around part of the sensor unit. In such an embodiment, the force of the rubber band can be fully or partially transferred to the sensor unit, allowing force to be measured directly.

In an alternative embodiment, the sensor is attached to the rubber band, by passing the band through one or more holes, slits, rings or hooks in, or on the chassis. In this embodiment, the force can be fully or partially transferred to the sensor unit, and measured directly. In an alternative embodiment, the rubber-band thickness is measured by magnetic or inductive distance measurement, where a static or modulated magnetic field pass through the rubber-band, or between parts of the sensor unit, which distance wary with rubber-band thickness. As magnetic field strength decrease with distance, the magnetic field strength will b e a function of thickness. The magnetic field can be created by one or more permanent magnets, or by an electric current. The field strength can be measured by Hall effect, induction in an electric conductor, or as dynamic changes in an non-linear ferromagnetic material.

In an alternative embodiment, the rubber-band thickness is measured optically, by measuring transmission of electromagnetic radiation through the rubber-band, or between elements of the sensor unit which distance varies with the rubber-band thickness. As radiation is spread and absorbed over distance, thickness variations can be measured by transmission variations. The radiation can be generated by a constant, or modulated source, such as a LED, and be measured by a sensor, such as a photo-diode, -transistor or resistance.

In an alternative embodiment, the rubber-band strain is measured indirectly, by measuring angle, distance, pressure, force, or strain variations that arise in the chassis of the sensor unit, or between elements of the chassis, or between attachments to the sensor element, when the strain of the rubber-band varies. Such variations can be measured with potentiometer, pressure sensitive transducers, strain sensitive transducers, piezo electric effect, or by capacitive, inductive, magnetic or optical distance- or angle-measurement.

The invention claimed is:

1. Sensor unit for monitoring of physical training with a rubber band comprising:

(a) a housing enclosing:

(i) a frame;

(ii) attachment means, such as fixing clamps, for attaching the sensor to the rubber band;

(iii) power source;

(iv) means for measuring the tension of the rubber band, said means being associated with the attachment means;

(v) an internal or remote processor for processing data received from the means for measuring the tension of the rubber band; and (vi) optionally a signal transmitter for cable or wireless data transfer of the data to an external device;

wherein the means for measuring the tension is an integral part of the attachment means, and measured by means of one or more detectors that are sensitive to, or coupled to the mechanical deformation in one or more dimensions of the rubber band, said means selected from the group consisting of:

(b) an electronic circuit comprising two or more electrical conductors in a structure completely or partially based on measuring their mutual capacity as a function of the deformation of the rubber band;

(c) magnetic coupling between two or more elements in a magnetic circuit, in a construction where the magnetic coupling is a function of the mechanical deformation of the rubber band; and (d) transmission of electromagnetic radiation in a structure where the transmission of the radiation from one or more sources is a function of the mechanical deformation of the rubber band.

2. Sensor unit according to claim 1, wherein the sensor unit is fixed onto the rubber band by squeezing the rubber with a force generated by a spring or resilient element that may be a separate component or an integral part of the attachment means.

3. Sensor unit according to claim 1, wherein the sensor unit is held on the rubber band by squeezing the rubber band with a force created by magnetism.

4. Sensor unit according to claim 1, wherein the sensor unit is held on the rubber band, by winding or bind the rubber band around the sensor assembly or components of the sensor assembly.

5. Sensor unit according to claim 1, wherein the sensor unit is held on the rubber band, by passing the rubber band through one or more holes, slots, rings or hooks in the attachment means.

6. Sensor unit according to claim 1, wherein the attachment means comprises fixing clamps.

7. Sensor unit according to claim 1, wherein the housing encloses a signal transmitter for cable or wireless data transfer of the data to an external drive.

8. Sensor unit for monitoring of physical training with a rubber band comprising:

(a) a housing enclosing:

(i) a frame;

(ii) attachment means, for attaching the sensor to the rubber band;

(iii) power source;

(iv) means for measuring the tension of the rubber band, said means being associated with the attachment means;

(v) an internal or remote processor for processing data received from the means for measuring the tension of the rubber band; and (vi) optionally a signal transmitter for cable or wireless data transfer of the data to an external device;

wherein the means for measuring the tension is an integral part of the attachment means, and wherein the tensile force of the rubber band is transferred to the sensor assembly by the attachment means, as tension or compression, and is measured directly by one or more pressure or traction sensitive measuring devices, such as strain gauges, piezo-resistive, piezo-electrical, and capacitive force sensors.

9. Sensor unit according to claim 8, wherein the attachment means comprises fixing clamps.

10. Sensor unit according to claim 8, wherein the housing encloses a signal transmitter for cable or wireless data transfer of the data to an external device.

11. Sensor unit according to claim 8, wherein the one or more pressure or traction sensitive measuring devices comprise strain gauges, piezo resistive sensors, piezo electrical sensors, or capacitive force sensors.

12. Sensor unit for monitoring of physical training with a rubber band comprising:

a housing enclosing:

(i) a frame;

(ii) attachment means, for attaching the sensor to the rubber band;

(iii) power source;

(iv) means for measuring the tension of the rubber band by virtue of the mechanical resonance frequency of the rubber band, and (v) an internal or remote processor for processing data received from the means for measuring the tension of the rubber band, wherein the sensor is fixed on the rubber band by one of: squeezing the rubber with a force generated by a spring or resilient element that may be a separate component or an integral part of the attachment means; squeezing the rubber band with a force created by magnetism; winding or bind the rubber band around the sensor assembly or components of the sensor assembly; or passing the rubber band through one or more holes, slots, rings or hooks in the attachment means (vii) optionally a signal transmitter for cable or wireless data transfer of the data to an external device.

13. Sensor unit according to claim 12, wherein the attachment means comprises fixing clamps.

14. Sensor unit according to claim 12, wherein the housing encloses a signal transmitter for cable or wireless data transfer of the data to an external device.

15. Sensor unit according to claim 12, wherein the means for measuring the tension of the rubber band comprises one or more sensors.

16. Sensor unit according to claim 12, wherein the means for measuring the tension of the rubber band comprises one or more accelerometers.

* * * * *